United States Patent [19]

Johansen et al.

[11] 4,252,460

[45] Feb. 24, 1981

[54] RETAINING WALL AND METHOD OF FORMING SAID WALL

[75] Inventors: Carlos W. Johansen, Delta; Kenneth A. Downie; Jitendra Khanna, both of North Vancouver; Norman F. B. Allyn, Vancouver, all of Canada

[73] Assignee: Swan Wooster Engineering Co. Ltd., Vancouver, Canada

[21] Appl. No.: 961,739

[22] Filed: Nov. 17, 1978

[51] Int. Cl.[3] ..... E02B 3/04

[52] U.S. Cl. ..... 405/23; 405/25; 405/63

[58] Field of Search ..... 405/11–15, 405/22–27, 60–73, 112, 114, 116, 211, 217

[56] References Cited

U.S. PATENT DOCUMENTS

| | | | |
|---|---|---|---|
| 2,584,867 | 2/1952 | Guarin | 405/23 |
| 3,456,265 | 7/1969 | Carnahan | 405/67 X |
| 3,499,291 | 3/1970 | Mikkelsen | 405/66 |
| 3,592,005 | 7/1971 | Greenwood | 405/71 |
| 3,592,008 | 5/1971 | Trindle | 405/67 X |
| 4,118,941 | 10/1978 | Bruce et al. | 405/211 X |

*Primary Examiner*—Dennis L. Taylor

*Attorney, Agent, or Firm*—Knobbe, Martens, Olson, Hubbard & Bear

[57] ABSTRACT

A wall is formed by stringing on cables a plurality of similar buoyant panel elements lying flat on water. Each panel element has an inner end, an outer end and two side edges. A first chain extends laterally through the panel elements adjacent the inner ends thereof and a second chain extends laterally through these elements spaced from the first chain. The first chain is tensioned to draw the panel elements together to abut each other at the inner ends thereof. The second chain is then tensioned while water ballast is added to compartments in the elements to cause the outer ends of the panel elements to swing downwardly to bring the side edges thereof together to form a wall. The resulting structure is made up of these panel elements side by side. Gripping means at the ends of the cables maintain them under tension to retain the side edges of the panel elements together.

4 Claims, 11 Drawing Figures

RETAINING WALL AND METHOD OF FORMING SAID WALL

FIELD OF THE INVENTION

This invention relates to a method of forming a retaining wall and the retaining wall so formed.

The present invention is primarily concerned with a method of constructing a retaining wall which is suitable for retaining dredged fill to form an artificial island or reclaimed land. Thus, the wall and the components thereof are relatively large. However, the invention is also useful in forming a straight wall or a curved wall, for example as a breakwater.

PRIOR ART

Efforts have been made in the past to form retaining walls of truncated cone formation but these had to be constructed in situ. Examples of these prior walls are disclosed in U.S. Pat. No. 916,859 dated March 30, 1909 and U.S. Pat. No. 946,841 dated Jan. 18, 1910. The structures of these patents are coffer dams which must be relatively small, and they are made up of relatively small components for ease of handling.

U.S. Pat. No. 2,939,290 dated June 7, 1960 discloses a wall formed of buoyant sections hinged together at edges thereof. The vertical wall sections are interconnected while in the water, which presents problems, and then are towed to the desired location. According to the patent, the wall sections are arranged vertically when being towed. As a result the joined wall sections cannot be towed in shallow water, and the size of the sections and the length of the wall are limited by handling problems.

SUMMARY OF THE INVENTION

The present invention provides a wall formed in panel elements or sections which may be towed in shallow water to the area where the wall is required, and this wall can be comparatively quickly and easily erected into operational position. Once the panels have been placed in the water, they are assembled into the wall and the wall erected without having to handle the full weight of the panel elements at any time. Thus, large panel elements and long walls can be easily handled.

The method according to the present invention of forming a wall in a body of water comprises the steps of stringing on chains a plurality of similar buoyant panel elements lying flat on the water and each having an inner end, an outer end and two side edges, a first chain extending laterally through the panel elements adjacent the inner ends thereof and a second chain extending laterally through said panel elements spaced from the first chain, tensioning the first chain to draw the panel elements together to abut each other at the inner ends thereof, and tensioning the second chain and, simultaneously with the tensioning of the second chain, ballasting the panel elements adjacent the outer ends thereof to cause the outer ends of the panel elements to swing downwardly to bring the side edges of said elements together thereby forming a wall.

A retaining wall according to this invention comprises a plurality of similar buoyant panel elements side by side, each panel element having an inner end, an outer end and two side edges, a first chain extending laterally through the panel elements adjacent the inner ends thereof, a second chain extending laterally through the panel elements spaced from the first chain, and gripping means at ends of said chains maintaining the chains under tension to retain the side edges of the panel elements together thereby maintaining the wall.

In a preferred embodiment the invention is directed to a method of forming an endless retaining wall and to the endless wall so formed. In this preferred embodiment the panel elements are trapezoidal, having relatively short inner ends and longer outer ends. Tensioning of the first chain forms a ring of the panel elements. With tensioning of the second chain a retaining wall of generally truncated cone shape is formed.

The term "chain" as used herein and in the accompanying claims is intended to include chain, wire cable or any other strong, flexible element adapted to be threaded through the panels and then tensioned to hold the panels together.

A retaining wall and a method of erecting said wall are illustrated, merely by way of example of the invention in the accompanying drawings, in which:

FIG. 1 diagrammatically illustrates interconnected panel sections of this invention being towed to the site for erection, FIG. 2 diagrammatically illustrates one method of erecting a retaining wall at the first step of the method, FIG. 3 is a view similar to FIG. 2 illustrating an alternative method of erecting a retaining wall at the first step of the method, FIG. 4 is a diagrammatical section taken on the line 4—4 of FIG. 1, FIG. 5 diagrammatically illustrates a panel section being moved from its towing position to the wall position thereof, FIG. 6 is a reduced fragmentary plan of an erected retaining wall in accordance with this invention, FIG. 7 is a reduced section taken on the line 7—7 of FIG. 6, FIG. 8 is an enlarged end elevation of a panel element in its wall position, FIG. 9 is an enlarged section taken on the line 9—9 of FIG. 8, FIG. 10 illustrates gripping means useful to maintain the chains under tension, and FIG. 11 is a section on the line 11—11 in FIG. 10.

DESCRIPTION OF THE PREFERRED EMBODIMENTS

Figure 1:
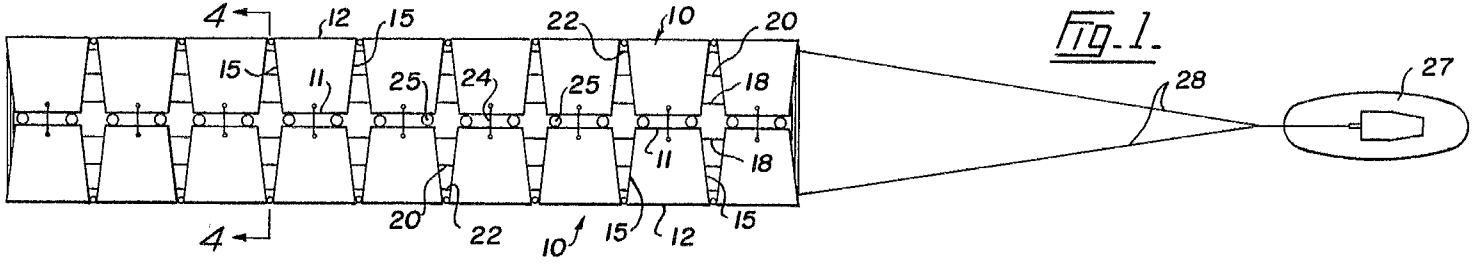

Referring to the drawings, a retaining wall in accordance with the illustrated embodiment of this invention is made up of a plurality of similar trapezoidal and buoyant panel elements 10, each panel element having a relatively short inner end 11, a longer outer end 12 substantially parallel to the inner end, and side edges 15 which converge from the outer end to the inner end. An upper or first chain 18 is threaded laterally through the panel elements 10 adjacent the inner ends 11 thereof. One or more additional chains is or are threaded laterally through the panel elements spaced from chain 18, and in the illustrated, preferred form of the invention there is a second or intermediate chain 20 extending through the panel elements substantially midway between the ends thereof, and a third or lower chain 22 threaded laterally through the panel elements adjacent the outer ends 12 thereof. The panel elements can be threaded on the chains one at a time on shore, each panel element being drawn into the water as soon as it is threaded on the chains. Alternatively, the panel elements can be floated flat on the water and threaded onto the chains in shallow water.

The panel elements can be towed in a single string to the site of erection, or they can be towed in two adjacent strings, as shown in FIG. 1. In this case, it is preferable to position the panels or panel elements in pairs, as shown, with their adjacent inner ends interconnected by lashings 24 with resilient bumpers 25 between the adjacent ends. The buoyant panel elements are strung on their chains at this time, and the interconnected panel elements can be towed by a tug 27 by means of tow lines 28 connected to one end of the interconnected strings of panel elements.

Figure 2:
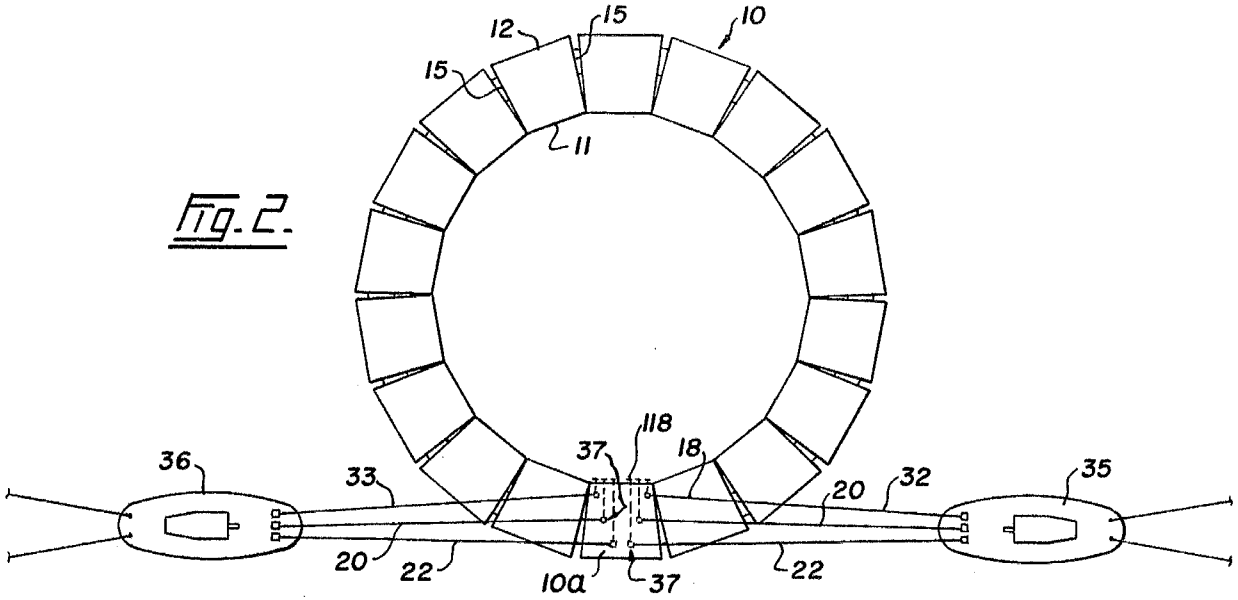

FIG. 2 illustrates the first step of one method of erecting the interconnected channel elements 10 into a wall. The first chain 18 which is adjacent the inner ends of the panel elements has its opposite ends 32 and 33 emerging from one of the panels 10*a*. These chain ends 32 and 33 extend away from each other to suitable tensioning means, and in this example, the chain ends extend to and are wound on to drums on tugs 35 and 36 which are spaced apart and anchored. The ends of the first chain 18 are winched in to draw the panel elements 10 into a circle and abutting each other at the inner ends 11 thereof. The panel elements are formed with floodable buoyancy chambers or compartments adjacent their outer ends 12, as described later, and water is now permitted to enter these chambers to ballast the panel elements adjacent the outer ends thereof.

The second and third chains 20 and 22 have ends extending away from each other to winch drums on the tugs 35 and 36. After the outer ends of the panel elements have been ballasted, chains 20 and 22 are consecutively tensioned by means of the winch drums. This action and the ballasting of the outer ends of the panel elements cause these elements to swing from the horizontal or floating position to an inclined position with their side edges 15 abutting each other to form a continuous retaining wall of substantially hollow truncated cone formation. The ends of the chains are then anchored in any suitable way so as to maintain the chains under tension. This anchoring is shown generally at 37 and is shown more fully in FIGS. 10 and 11.

Figure 3:
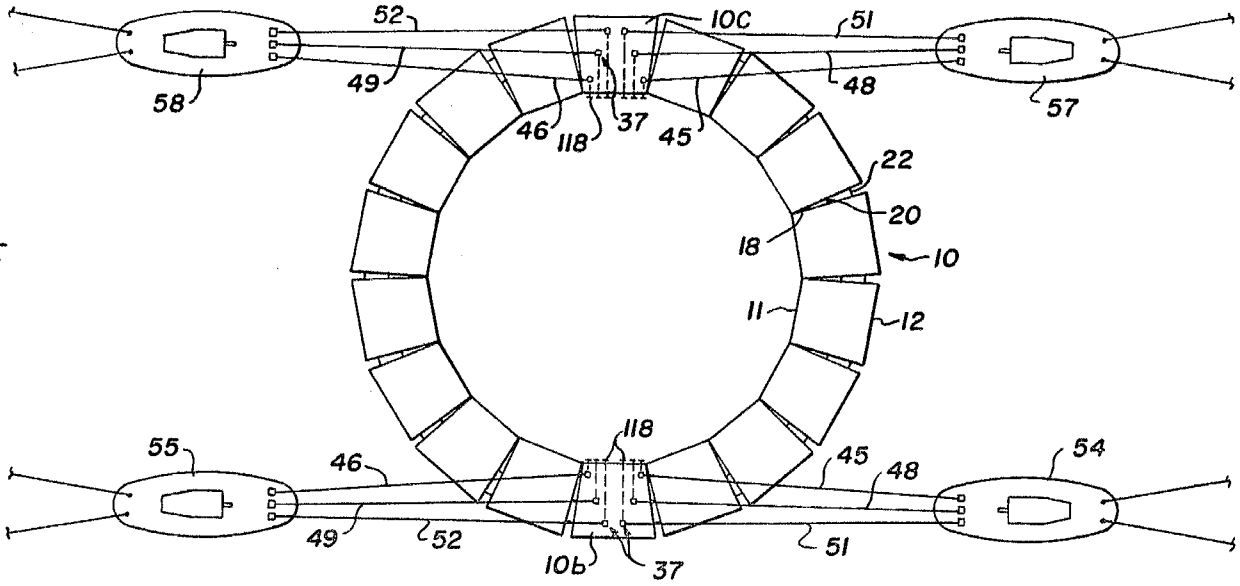
Figure 4:
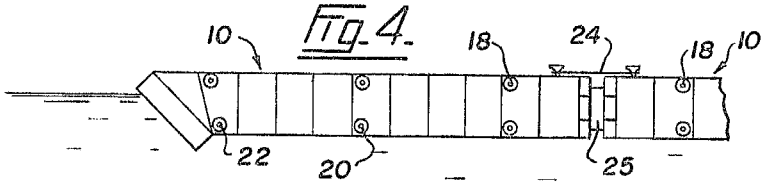
Figure 5:
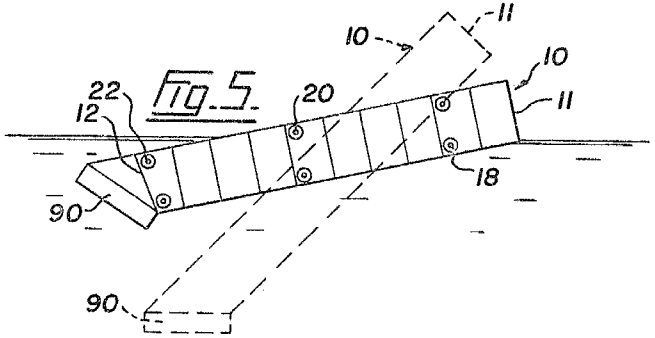

FIG. 3 diagrammatically illustrates an alternative method of tensioning the chains that interconnect the panel elements 10. In this example the first or upper chain 18 is formed in two sections 45 and 46, the intermediate chain 20 is formed in two sections 48 and 49, and the third or lower chain 22 is formed in two sections 51 and 52. The opposite ends of chain sections 45, 48 and 51 emerge from a panel element or section 10*b* and another panel element or section 10*c*, which is substantially diametrically opposite said section 10*b*, to winch drums on anchored tugs 54 and 55. Similarly, the opposite ends of chain sections 46, 49 and 52 emerge from the panel elements 10*b* and 10*c* to anchored tugs 57 and 58. Tugs 54 and 57 are opposed to each other while tugs 55 and 58 are opposed to each other. The three chains 18, 20 and 22 are consecutively tensioning by winching in the ends of their respective chain sections and anchoring them as shown generally at 37.

Figure 6:
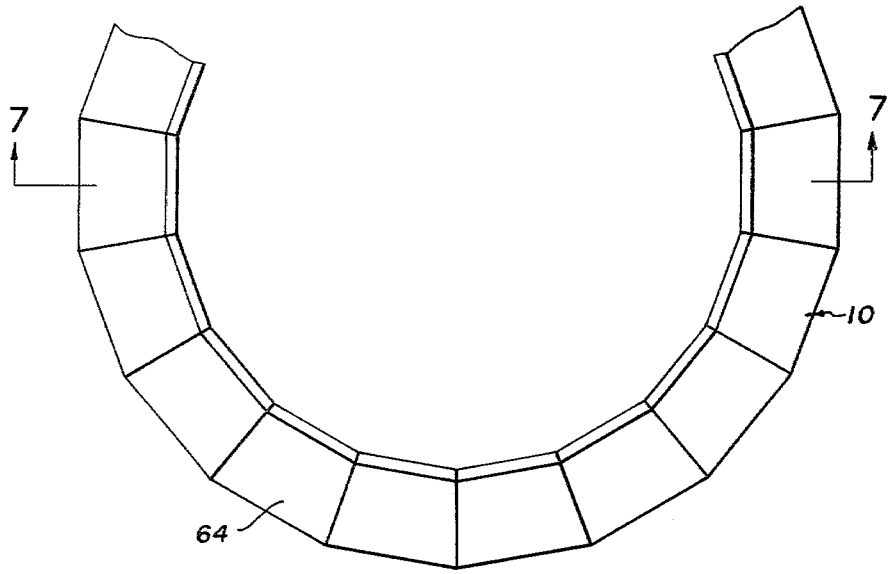

FIGS. 6 to 9 illustrate in detail panel elements 10 arranged in an endless retaining wall 64. As seen in FIG. 6, 64 is an endless wall made up of panel elements 10 located side by side and retained firmly together by the previously-mentioned tensioned upper, intermediate and lower chains, not shown.

Figure 8:
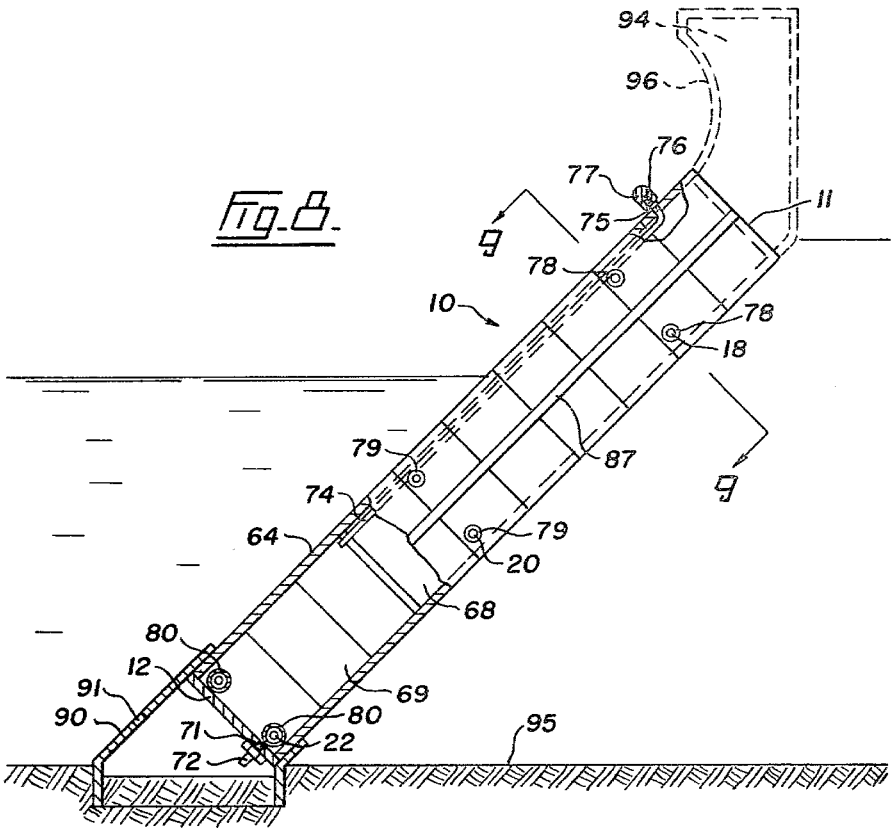
Figure 9:
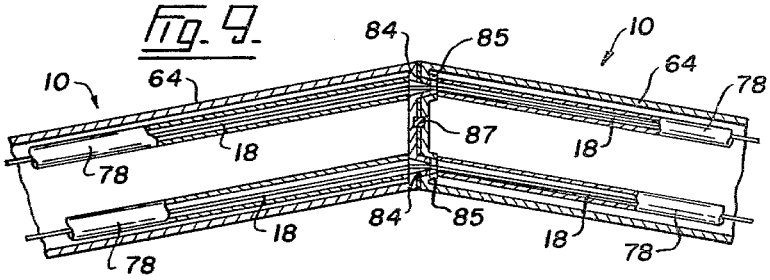

Each panel element 10 can be of any suitable construction as long as it is buoyant and strong enough to withstand the stresses to which it is subjected when in use. FIGS. 8 and 9 illustrate a panel element 10 by way of example. As this panel element must be buoyant, it is formed with a main buoyancy chamber or compartment 68. Although only one main buoyancy chamber 68 is shown, it can be divided into a plurality of water-tight compartments. The illustrated panel element also includes at least one buoyancy compartment 69 adjacent its outer end 12. A port 71 opens into each compartment 69 and is normally closed by a valve 72. When valve 72 is opened, water flows into compartment 69 to ballast the outer end of the panel element. Suitable means is provided for expelling water from each compartment 69, when desired. In this example, a pipe 74 extends from the top of compartment 69 towards the inner end 11 of the panel element, and has a threaded end or nipple 75 which extends out of the panel element near the end 11 thereof. This nipple has an air valve 76 therein and is normally closed by a cap 77. If desired, a similar pipe arrangement (not shown) may be provided for each compartment 68, in which case the latter compartment may have a port and valve arrangement (not shown) similar to port 71 and valve 72.

As the panel elements need to slide along the chains, the elements of FIG. 8 have pairs of tubes 78, 79 and 80 for the upper, intermediate and lower chains, respectively. These tubes extend laterally through the panel elements. Each panel element 10 has male cones 84 on one edge thereof at each of the cable tubes, and matching female cones 85 at the tubes on its opposite edge. If desired, a resilient seal 87 may extend longitudinally from each edge of each panel centrally thereof and projecting therefrom.

When the panel elements are drawn together by the chains, the matching cones 84 and 85 thereof interfit and the rubber seals 87 bear against each other, as clearly shown in FIG. 9.

Although not necessary, it is desirable to provide a key 90 on the outer end of each panel element and opening downwardly therefrom when said element is inclined in a wall, as shown in FIG. 8. Key 90 has a port 91. If desired, after the wall 64 has been erected, a breakwater or ice deflector 94 can be mounted on the inner or upper edges 11 of the panel elements to extend completely around the wall.

As described above, the panel elements, threaded on the upper, intermediate and lower chains, are drawn into a circle by tensioning the upper chain or upper chain sections. Then the valves 72 are opened in the panel elements, following which the intermediate and lower chains or chain sections are successively tensioned. This causes the outer or lower ends of the panel elements to swing downwardly. As the water floods the compartments 69, the panel elements are ballasted so as to assist this action.

The matching cones 84, 85 interfit as the panel elements are drawn together, and the seal strips 87 pressed against each other. The panels still retain a degree of buoyancy at this time. After the chains have been securely locked by anchors, the valves 76 can be opened to allow the trapped air to escape from compartments 69. This allows the erected wall 64 to settle down onto the bottom 95 of the body of water. This causes the open keys 90 to sink into the bottom to provide anchor means at the lower or outer edge of the wall. Port 91 permits water to escape.

Figure 7:
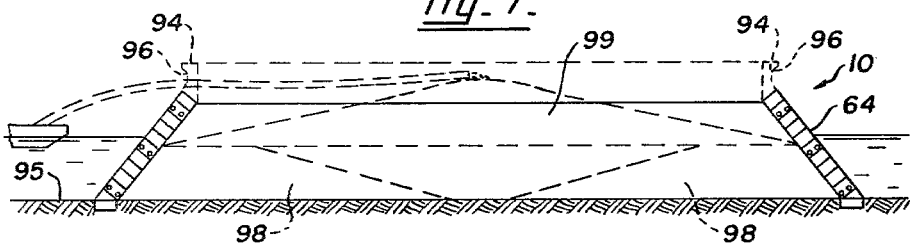

FIG. 7 is a sectional view through wall 64 in place on the water bottom 95. The wall is in the form of a truncated cone. Suitable fill material is now directed into the space within the wall by any desired means, such as a dredge pump. It is desirable first to direct fill into the areas 98 adjacent the wall so as to be sure that the fill supports the wall from its lower or outer edge up. After this has been done, additional fill material is directed into the central area 99 and then smoothed out to a desired level, usually near the upper or inner edge of the wall. The truncated cone formation of the wall provide extremely good bracing or support therefor. Any inward pressure against the upper ends of the panel elements causes them to jam more tightly together. In addition to this, the filled material located inside the wall and beneath the panel elements thereof back or support these elements against external pressure. The deflector 94, if used, has a concave outer surface 96 which acts a breakwater and a deflector for ice or other materials floating on the water outside the wall.

Figure 11:
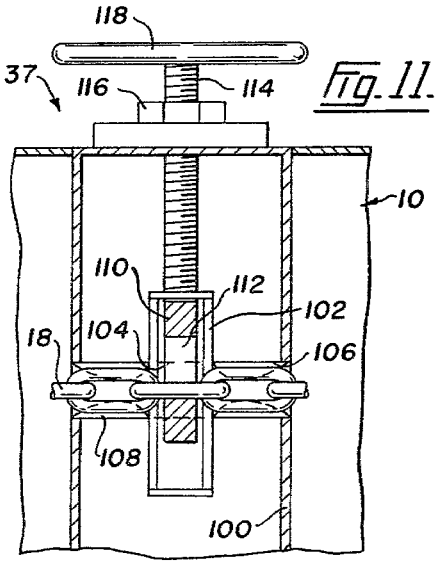
Figure 10:
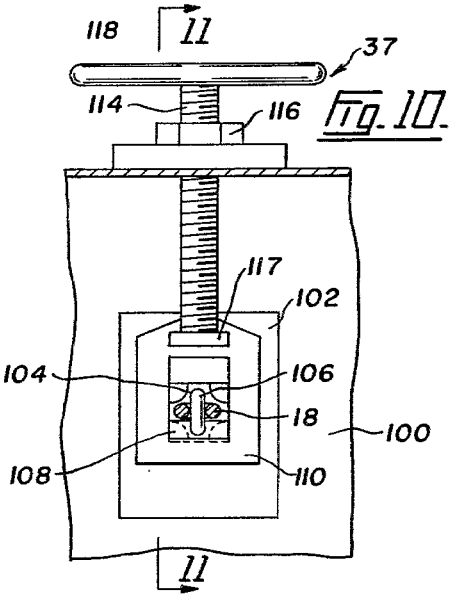

FIGS. 10 and 11 illustrate one device useful in retaining chains 18, 20 and 22 under tension in the erected wall. Chain 18 is shown for illustration. The device comprises a tube 100 entering an element 10. A gate 102 is located in tube 100. Gate 102 has a central opening 104. There is a transverse path 106 for the chain 18 leading to and through the opening 104. Aligning projections 108 are positioned in the path 106 to align the chain 18 in a desired position in the opening 104.

There is a locking member 110 slidable within the gate 102. This locking member 110 has an opening 112 sufficiently large that chain 18 can pass through. A threaded rod 114 extends from the member 110 axially of the tube 100, through a nut 116. The rod 114 is connected to the locking member 110 by a swivel joint 117. Wheel 118 is positioned on the threaded rod 114. The arrangement is such that rotation of wheel 118 turns the rod 114 in nut 116, thus moving the rod axially in the tube 100. As a result, locking member 110 can be moved from an open position in which opening 112 in member 110 is aligned with path 106 and chain 18 can pass through the position shown in FIGS. 10 and 11 to a closed position where the opening 112 is not aligned with path 106 so the chain 18 is gripped and cannot pass through.

The device can thus be used to lock into position chain 18 under the required tension but, by appropriate rotation of the wheels 118 to position the locking member 110, can also permit free passage of the chain 18.

It should be noted that although trapezoidal panels 10 have been illustrated, straight sided panels may also be used. This produces a straight wall. Further it is not necessary to produce an endless wall with trapezoidal panels. An arcuate wall can obviously easily be produced.

We claim:

1. A retaining wall comprising a plurality of similar, flat bouyant panel elements side by side in a wall, each panel element being trapezoidal, having a relatively short upper end and a longer lower end, the elements being inclined inwardly to form an endless wall of truncated cone formation, water tight compartments in the panel elements adjacent the lower ends thereof, and means in each compartment to permit water to enter and leave said each compartment to provide and remove ballast respectively, a first chain extending laterally through the panel elements adjacent the inner ends thereof, a second chain extending laterally through the panel elements spaced from the first chain, and gripping means at ends of each chain maintaining the chain under tension to retain the said edges of the panel elements together thereby maintaining the wall.

2. A retaining wall as claimed in claim 1 comprising a key mounted on the lower end of each panel element and opening downwardly therefrom when said element is inclined in the wall; a part in a side of the key, said key acting to sink into the bottom of a body of water in which the wall is formed to assist in anchoring the wall, the part permitting water to escape from inside the key.

3. A retaining wall as claimed in claim 1 comprising a third chain extending laterally through the panel elements adjacent the outer ends thereof, and gripping means at ends of the third chain maintaining said third chain under tension.

4. A retaining wall as claimed in claim 3 comprising a key mounted on the lower end of each panel element and opening downwardly therefrom when said element is inclined in the wall; a part in a side of the key, said key acting to sink into the bottom of a body of water in which the wall is formed to assist in anchoring the wall, the part permitting water to escape from inside the key.

* * * * *